US005407277A

United States Patent [19]

Burke et al.

[11] Patent Number: 5,407,277

[45] Date of Patent: Apr. 18, 1995

[54] TAMPER EVIDENT BAG WITH AUXILIARY BAG

[75] Inventors: James W. Burke, Cleves, Ohio; Cynthia M. Miller, Fairland, Ind.

[73] Assignee: KCL Corporation, Shelbyville, Ind.

[21] Appl. No.: 156,456

[22] Filed: Nov. 23, 1993

[51] Int. Cl.[6] ..... B65D 33/34

[52] U.S. Cl. ..... 383/5; 206/459.1; 206/807; 383/40; 383/63

[58] Field of Search ..... 206/459.5, 807, 459.1; 383/5, 38, 40, 63

[56] References Cited

U.S. PATENT DOCUMENTS

| | | | |
|---|---|---|---|
| 3,720,367 | 3/1973 | Rayner et al. | 383/40 X |
| 4,407,443 | 10/1983 | McCorkle . | |
| 4,509,109 | 4/1985 | Sak et al. . | |
| 4,720,040 | 1/1988 | Gurewitz . | |
| 4,733,817 | 3/1988 | Makowka . | |
| 4,834,552 | 5/1989 | Makowka . | |
| 4,838,708 | 6/1989 | Holcomb et al. . | |
| 4,937,040 | 6/1990 | Holcomb et al. . | |
| 4,941,196 | 7/1940 | Edelman et al. | 383/5 |
| 4,993,844 | 2/1991 | Robinson et al. | 383/63 X |
| 4,998,666 | 3/1991 | Ewan . | |
| 5,077,001 | 12/1991 | Makowka | 383/5 |
| 5,318,364 | 6/1994 | Rader | 383/5 |

*Primary Examiner*—Bryon P. Gehman
*Attorney, Agent, or Firm*—Woodard, Emhardt, Naughton, Moriarty & McNett

[57] ABSTRACT

A security bag having attached thereto an auxiliary bag with a reclosable zipper. The security bag is sealable by a flap having hot melt adhesive thereon. Tamper evidence is provided by a permanent color change of a colored marking adjacent the flap. The color change results from the application of extreme cold temperature to the flap.

6 Claims, 4 Drawing Sheets

TAMPER EVIDENT BAG WITH AUXILIARY BAG

BACKGROUND OF THE INVENTION

This invention pertains to the field of security bags or pouches for carrying money or other valuable items. More particularly, the invention concerns a security bag having a tamper evident closure.

Businesses frequently transmit money or other valuables to other businesses and to banks. Often, these businesses will use a canvas deposit bag that is provided with a lock and key in order to secure the contents of the bag. In recent years, the canvas bag has been replaced with security pouches or bags composed of flexible plastic or polyester that exhibit the same strength characteristics as the canvas bags. Rather than a lock and key, these plastic bags use a number of adhesive strips mounted on a closure flap that is folded over the opening of the bag to close and seal the bag. The plastic bags of the prior art are tamper resistant in the event that the closure flap is pulled apart from the opening of the bag because the plastic bag material distorts and tears at the portions where the adhesive attaches the flap onto the bag.

However, one difficulty with these plastic bags is that the closure flap can be readily and cleanly disengaged when subject to very cold temperatures. For instance, when the closure flap and adhesive is exposed to a Freon gas, the flap can be pulled away from the bag opening without leaving any evidence that the flap has been opened. Consequently, there is a need for a security bag or pouch that provides a permanent visible indication that the bag has been tampered with, even when the flap has been opened without distortion of the bag material.

One example of a device for dealing with this problem is shown in U.S. Pat. No. 4,941,196 to Edelman et al. which includes a security pattern in the strip of tape used to close the bag opening. When the bag is properly closed the security pattern is imperceptible. The pattern becomes visible when the closure flap is pulled from the wall panel. The security pattern remains visible even when the flap has been resealed over the opening to give a positive visible indication of tampering with the security bag. It has been found, however, that the cost of such security patterns is relative expensive.

Another feature which is desirable in a security bag is an auxiliary bag on the side of the security bag which can be used to contain a deposit slip and/or checks while the tamper evident portion of the bag is used to contain the negotiable cash or other such valuable items. It is desirable that such an auxiliary bag include means for easily and effectively opening and closing the auxiliary bag without causing stickiness to the fingers and to items being placed into or taken out of the auxiliary bag.

SUMMARY OF THE INVENTION

One embodiment of the present invention might involve a security bag which includes a pair of wall panels. Each of the wall panels has a bottom, sides and a top. The wall panels are joined together at the bottoms and the sides and define an opening at the tops. A closure flap for closing the opening is provided with the closure flap being mounted on one of the pair of side panels and having adhesive thereon and adapted to fold over the opening to close the opening by the adhesive attaching the flap to the other of said pair of wall panels. There is also provided a colored marking on the bag adjacent to the adhesive. The colored marking is adapted to noticeably change in color when the adhesive is subjected to a substantial change in temperature.

In another aspect of the invention, the other of the pair of wall panels is folded back upon itself to define a third wall panel. The third wall panel is joined at its sides to the sides of the pair of wall panels and defines with the pair of wall panels an auxiliary bag with a second opening at the bottom of the pair of wall panels. There is further provided a pair of cooperating profile zippers mounted on the third wall panel as well as on one of the pair of wall panels at the second opening for reclosably closing the second opening of the auxiliary bag.

It is an object of the present invention to provide an improved tamper evident bag with auxiliary bag.

DESCRIPTION OF THE PREFERRED EMBODIMENT

Figure 1:
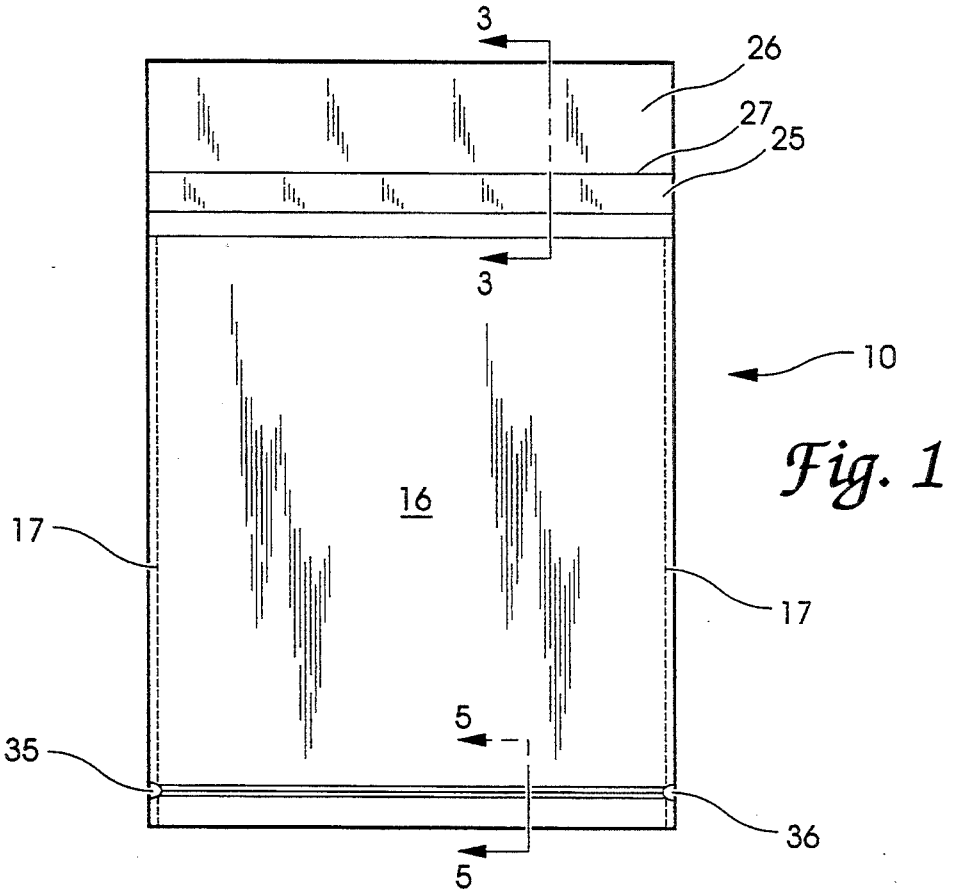
FIG. 1 is a front elevation of the tamper evident bag of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

In a preferred embodiment of the present invention, a tamper evident bag or pouch 10 includes a first wall 11 and a second wall 12. The second wall 12 is folded back upon itself at 15 to form a third wall 16. The first, second and third walls are sealed at their lateral edges along seams 17. The walls 11 and 12 are also joined together at their bottoms by means of a seam 20. The tamper evident bag thus configured has an opening 21 at the top of the bag. The wall 11 includes a closure flap 22 having hot melt adhesive or some other suitable adhesive thereon covered by a release liner 25. The wall 11 also includes a receipt strip removably connected to the flap 22 along a perforation line 27.

The auxiliary bag is defined by the third wall panel 16 and the second wall panel 12 which have a second opening at 30 at the bottom of the second wall panel 12. A pair of cooperating male and female zippers 31 and 32 are mounted respectively upon the third wall 16 and the second wall 12 for reclosably closing the second opening 30 of the auxiliary bag. The ends of the zippers 30 and 31 are sealed together by a spot seals 35 and 36.

If desired, the wall 11 may be opaque while the walls 12 and 16 are transparent. The walls 11, 12 and 16 may be made out of high density polyethylene with a low coefficient of the friction COF to aid in sealing and to prevent or reduce slip. The hot melt adhesive could be obtained, for example, from Ecomelt Adhesives of Paramount, Calif. under the product name FP-FX-11.

Figure 2:
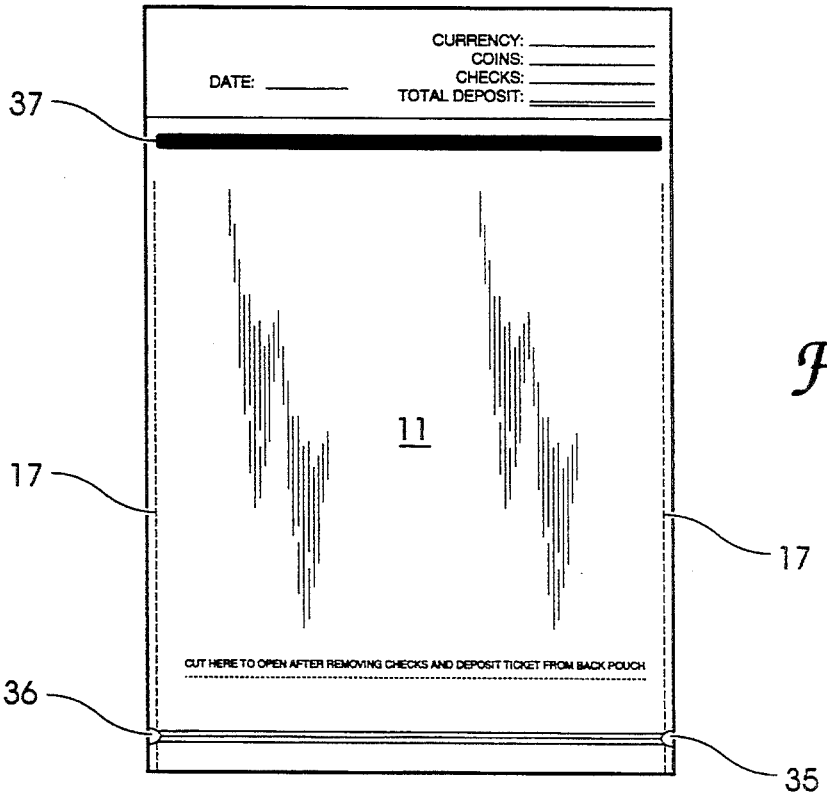
FIG. 2 is a rear elevation of the tamper evident bag of the present invention.
Figure 3:
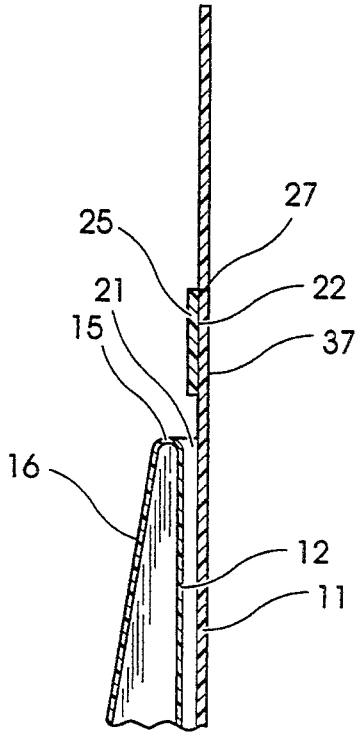
FIG. 3 is an enlarged section taken along the line 3—3 of FIG. 1 in the direction of the arrows.
Figure 4:
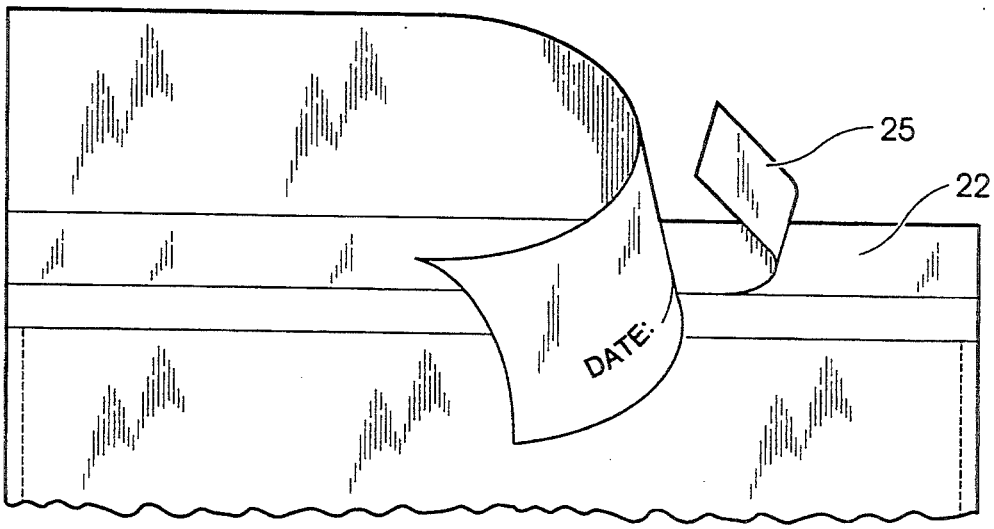
FIG. 4 is a fragmentary elevational view of the upper portion of the tamper evident bag as shown with the receipt strip partially removed at the perforation line and the release liner partially pulled away from the adhesive strip of the closure flap.
Figure 5:
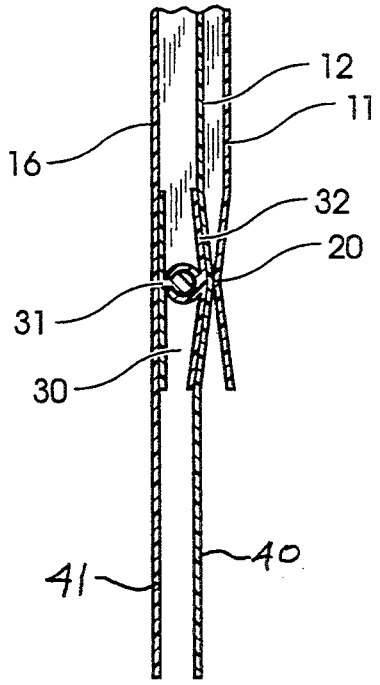
FIG. 5 is an enlarged section taken along the line 5—5 of FIG. 1 in the direction of the arrows.
Figure 6:
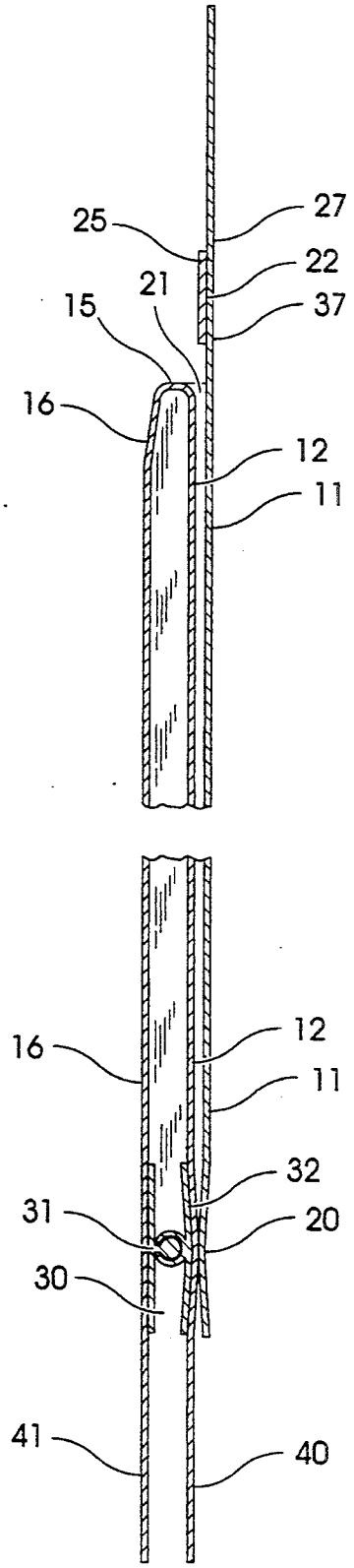
FIG. 6 is a cross sectional side view of the tamper evident bag of FIG. 1.

A thermal indicator 37 is placed adjacent the adhesive of the closure flap 22. The thermal indicator 37 could be placed as shown in FIG. 2 on the back side of the flap away from the adhesive or could be placed at any other convenient location adjacent to the adhesive. Thermal indicator 37 includes a thermochromic ink or another substance which provides a lasting visual indication when it has been subjected to extreme cooling. This visual indication can be, for example, a change in color or hue, or the appearance or disappearance of color. A suitable thermal indicator 37 can be created for example using Marks-A-Lot inks available from Avery-Dennison, Inc., Dennison Division, Framingham, Mass., U.S.A., which inks are commonly used in devices known by the trademark "Magic Marker". When subjected to extreme cooling, as by an attempt to tamper with the bag by contact with Freon or the like to produce a very cold temperature in order to detach the adhesive without damaging the bag, such inks will change color permanently so that tamper evidence is produced.

In one example of the invention the thermal indicator 37 was green when placed on the flap 22. After the flap was sealed by removal of the release liner 25 and the application of pressure to seal the flap to the wall 15 and 16, cold freon gas was applied to the flap 22. The green thermal indicator permanently changed in color to aqua.

It will be evident that the present device provides a security bag which has an auxiliary bag that is easily closed and opened repeatedly by pulling the profiles of the male and female zippers apart. This is accomplished by pulling apart the extensions 40 and 41 of the walls 12 and 16 respectively. It will also be evident that the above described color indicator provides an effective means of showing the security bag has been tampered with.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A security bag comprising:

a pair of wall panels; each having a bottom, sides and a top; said wall panels being joined together at said bottoms and said sides and defining an opening at said tops;

a closure flap for closing said opening, said closure flap being mounted on one of said pair of wall panels and having adhesive thereon and adapted to fold over said opening to close said opening by said adhesive attaching said flap to the other of said pair of wall panels;

and a colored marking on said bag adjacent to said adhesive, said colored marking being adapted to noticeably change in color in response to being subjected to a substantial change in temperature.

2. The security bag of claim 1 additionally comprising an extension strip removably connected to said closure flap along a perforation line, said extension strip being removable therefrom by tearing along said perforation line.

3. The security bag of claim 1 wherein said substantial change in temperature is extreme cold, said color change remaining even though the bag is returned to its original temperature.

4. A security bag comprising:

a first wall panel, a second wall panel; each of said wall panels having a bottom, sides and a top; said wall panels being joined together at said bottoms and said sides and defining an opening at said tops;

a closure flap for closing said opening, said closure flap being mounted on said first wall panel and having adhesive thereon and adapted to fold over said opening to close said opening by said adhesive attaching said flap to said second wall panel;

said second wall panel being folded back upon itself to define a third wall panel, said third wall panel being joined at its sides to said second wall panel and defining with said second wall panel an auxiliary bag with a second opening at the bottom of said second wall panel;

and a pair of cooperating profile zippers mounted on said second wall panel and said third wall panel at said second opening for reclosably closing said second opening of said auxiliary bag.

5. The security bag of claim 4 additionally comprising an extension strip removably connected to said closure flap along a perforation line, said extension strip being removable therefrom by tearing along said perforation line.

6. The security bag of claim 4 additionally comprising a colored marking on said bag adjacent to said adhesive, said colored marking being adapted to noticeably change in color when said adhesive is subjected to a substantial change in temperature.

* * * * *